US006726069B2

(12) United States Patent
Machover

(10) Patent No.: US 6,726,069 B2
(45) Date of Patent: Apr. 27, 2004

(54) BEVERAGE BOTTLE HOLDER

(76) Inventor: Jonathan Machover, 3 Dorchester Dr., Muttontown, NY (US) 11545

( * ) Notice: Subject to any disclaimer, the term of this patent is extended or adjusted under 35 U.S.C. 154(b) by 58 days.

(21) Appl. No.: 10/256,890

(22) Filed: Sep. 30, 2002

(65) Prior Publication Data

US 2003/0146255 A1 Aug. 7, 2003

Related U.S. Application Data

(60) Provisional application No. 60/352,972, filed on Feb. 1, 2002.

(51) Int. Cl.[7] ..... A45F 3/16
(52) U.S. Cl. ..... 224/148.7; 224/269
(58) Field of Search ..... 224/148.4, 148.7, 224/604, 605, 269, 414

(56) References Cited

U.S. PATENT DOCUMENTS 4,009,810 A * 3/1977 Shook ..... 224/414
5,060,832 A * 10/1991 Link ..... 224/414
5,344,055 A * 9/1994 Edwards ..... 224/401
5,398,948 A * 3/1995 Mathis ..... 280/11.19
5,456,393 A * 10/1995 Mathis et al. ..... 224/148.4
5,597,225 A * 1/1997 Davis ..... 362/473
5,819,997 A * 10/1998 Mathis et al. ..... 224/148.4

* cited by examiner

*Primary Examiner*—Stephen K. Cronin
(74) *Attorney, Agent, or Firm*—Charles E. Temko

(57) ABSTRACT

A wire-type bottle holder including provision for attachment to a golf club bag or belt loop of a user. The holder comprises a single length of wire with at least the bottle-engaging part thereof coated with a layer of synthetic resinous material with the remaining portion enclosed within a synthetic resinous tube. The free ends of the wire are bent to form a loop which retains an attachment means.

3 Claims, 1 Drawing Sheet

BEVERAGE BOTTLE HOLDER

RELATED APPLICATION

Reference is made to my copending provisional application, Ser. No. 60/352,972 filed Feb. 1, 2002, to which a claim of priority is made.

BACKGROUND OF THE INVENTION

This invention relates generally to the field of resilient bottle retaining devices of a type which may be attached to another object for convenient portability. Devices of this general type are known in the art, and the invention lies in specific structural details which provide simplification of manufacturing at substantially lowered cost, as well as improved convenience in use.

U.S. Pat. No. 4,009,810, granted Mar. 1, 1997 to Shook, discloses a holder of this type wherein frictional retention of the bottle is accomplished by partially enclosing those portions which engage the outer surface of the bottle with synthetic resinous sleeves, one of which prevents the separating of parallel wire segments, and thus retained the shape of the holder.

While not without substantial utility, this construction is not without shortcomings, including the presence of the abutting ends of the wire which are held in position by engagement of a synthetic resinous sleeve. With passage of time, the resiliency of the sleeve decreases, to allow the outer portion of the cage to spread when a bottle is inserted. The spreading of the adjacent outer legs, which are relatively long, has normally insufficient resiliency to urge the ends of the wire together. Thus, with passage of time, the gripping ability of the cage is substantially reduced.

Another problem with this construction is that the inner sleeve which surrounds the inner legs of the cage must be installed during the bending or shaping of the wire length, thus making the manufacture of the device substantially a and operation.

SUMMARY OF THE INVENTION

Briefly stated, the invention contemplates the provision of an improved device of the class described in which the above-mentioned disadvantages have been eliminated, or at least substantially ameliorated. To this end, the abutting ends of the wire forming terminals for the outer legs of the cage have been eliminated along with the accompanying sleeve. Both the inner and outer legs are dipped in a synthetic resinous coating making the surface which contacts the surface of the bottle with sufficient friction to provide a holster-like retaining action. The upper loop is thus eliminated, and a radially-outwardly extending loop provides means for attachment of the cage to another object, such as a golf bag or a belt loop. A resilient foam sleeve surrounds the inner legs for added resilient engagement of a bottle or container. The free ends of the wire forming the device are preferably welded and completely enclosed in synthetic resin. With the elimination of a large upper loop, the foam sleeve is readily engaged when the device is assembled.

BRIEF DESCRIPTION OF THE DRAWINGS

In the drawings, to which reference will be made in the specification, similar reference characters have been engaged to designate corresponding parts throughout the several views.

DETAILED DESCRIPTION OF THE DISCLOSED EMBODIMENT

Figure 1:
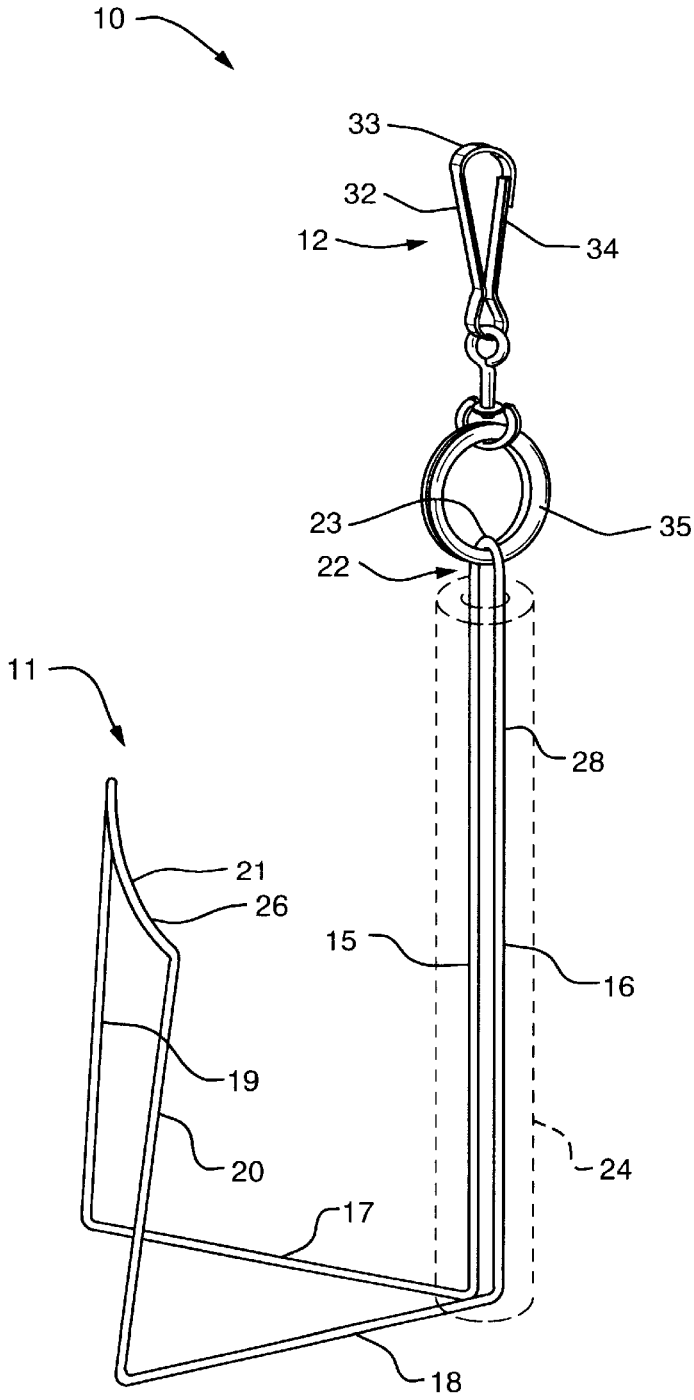
FIG. 1 is a schematic perspective view of an embodiment of the invention.
Figure 2:
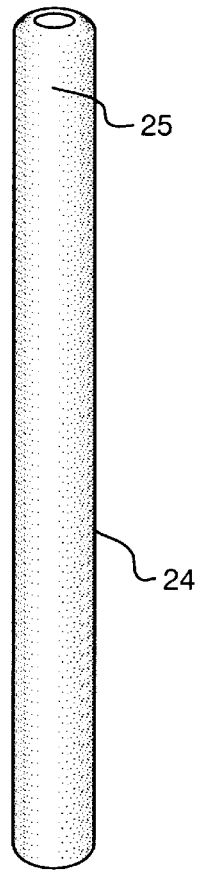
FIG. 2 is a perspective view of a single elongated synthetic resinous sleeve forming part of the embodiment.

In accordance with the invention, the device, generally indicated by reference character 10, includes a wire bottle retaining element forming a cage 11, and an object attachment element 12.

The cage element 15, as is known in the art, is formed from a single length of wire, including first and second inner legs 15 and 16, first and second bottom segments 17 and 18, first and second outer legs 19 and 20, and a bridge member 21. The free ends 22 of the wire are bent to form a small loop 23 which engages the element 12, and are welded together adjacent the loop.

Surrounding the inner legs is an elongated sleeve 24 of polyethylene foam, an outer surface 25 of which provides a frictional engaging surface for a portion of the bottle (not shown).

Preferably enclosing the entire wire and remaining components, including a portion of the inner legs, is a polyester coating solution 26 extending from the bridge 21 to at least a point 28 on the legs 16–17, which can be obtained by dipping the wire once it has been shaped in the coating solution. This is normally performed before installation of the sleeve 24.

The object attachment element 12 may take a variety of forms, such as a known standard spring hook 32, including a hook portion 33 and a pivotal spring member 34. A closed key ring loop 35 is positioned within the loop 23.

It is to be noted that an engaged bottle is contacted only by resilient synthetic resinous surfaces which extend over a substantial contact area, so that the cage requires only minimal spreading of the outer legs 19 and 20 during positioning and removal with very little force on the part of the user being required to engage and disengage a bottle.

I wish it to be understood that I do not consider the invention to be limited to the precise details of structure shown and described in the specification, for obvious modifications will occur to those skilled in the art to which the invention pertains.

I claim:

1. A beverage bottle holder comprising: single length of wire bent to form a pair of inner legs, a pair of bottom segments, a pair of outer legs, and a bridge member spanning an interstice between said outer legs; said wire having a synthetic resinous coating over the major exposed surface thereof to provide frictional resistance to movement of an engaged bottle; a synthetic resinous tube positioned over said inner legs providing additional frictional resistance, said single length of wire having adjacent free ends bent to form a loop; and an article attachment element secured to said loop for selective attachment to another object.

2. A bottle holder in accordance with claim 1, in which said coating is formed of a polyester.

3. A bottle holder in accordance with claim 2, in which said tube is formed of polyester foam.

* * * * *